US006010436A

United States Patent [19]

Obery et al.

[11] Patent Number: 6,010,436

[45] Date of Patent: Jan. 4, 2000

[54] BARBELL WITH WEIGHT BAR END CAP

[76] Inventors: Eric J. Obery, 138 Pine St., Apt. 3, Portland, Me. 04102; Charles Oransky, 17 Beachwood Ave., Kennebunkport, Me. 04046

[21] Appl. No.: 08/873,517

[22] Filed: Jun. 12, 1997

[51] Int. Cl.[7] ..... A63B 21/075

[52] U.S. Cl. ..... 482/93; 482/106; 482/107

[58] Field of Search ..... 482/48, 93, 106–109; 220/666; 215/900

[56] References Cited

U.S. PATENT DOCUMENTS

| | | | |
|---|---|---|---|
| 4,773,641 | 9/1988 | Metz . | |
| 4,817,944 | 4/1989 | Anderson et al. . | |
| 5,002,193 | 3/1991 | Tovzani | 220/666 |
| 5,135,455 | 8/1992 | King et al. | 482/108 |
| 5,407,413 | 4/1995 | Kupferman | 482/106 |
| 5,449,333 | 9/1995 | Carter . | |
| 5,603,680 | 2/1997 | Larsen | 482/107 |

*Primary Examiner*—John Mulcahy

[57] ABSTRACT

A protective end cap made of a resilient material that is received on the ends of a weight bar. The end cap has a series of annular ribs along its length that have a diameter larger than a through hole in a weight. An elastomeric stretchable weight, like a common wrist weight, can be secured onto the end cap by a user stretching it over the end of the end cap it letting contract between two of the ribs. The greater diameter of the ribs prevent longitudinal movement of the stretchable weight. A rigid weight disc can be secured on the end cap by forcibly pressing the weight disc over the ribs. The weight disc compresses the ribs, allowing the weight disc to pass along the end cap and rest against a flange at the other end. Ribs not compressed by the inner surface of the weight disc return to their original shape and their greater diameter keep the weight from sliding off.

20 Claims, 5 Drawing Sheets

BARBELL WITH WEIGHT BAR END CAP

BACKGROUND

1. Field of Invention

This invention relates to weight bar end caps, specifically to such end caps which are used for receiving and retaining external weight without the use of a separate collar.

2. Description of Prior Art

Fitness exercise bars that use interchangeable weights to vary resistance have been around for many years and are well known in this field. Most systems use a variation of a weight plate that slips onto either end of a bar and is secured by a locking collar mechanism. These collars do a good job securing the weights to the bar, but they make changing the weight more time consuming. Also, these collars are made of hard materials and offer no protection or cushioning if they are dropped, so damage to sensitive flooring material or injury to the user could result.

Some locking collar devices have been invented to make changing weights simpler and quicker. U.S. Pat. No. 4,817,944 to Anderson et al. (1989) discloses a collar locking device that slides against the weight and when its axis is skewed, frictionally holds the weight in place. U.S. Pat. No. 5,603,680 to Larson (1997) discloses a collar locking device that holds weights in place with springs and a contact base. U.S. Pat. No. 4,773,641 to Metz (1988) discloses a collar locking devise that uses the friction between o-rings within the devise and the greater diameter of the weight bar to retain the weights. All these disclosed devices still make the user attach the device to the bar to secure the weight and detach the device to remove the weight. This is time consuming. Also none of these devices offer any type of cushioning to the weight bar end so if it is dropped it can damage floors or cause injury to the user.

Some inventors have created weight systems that do not use a locking collar devise to secure the weight to the bar. U.S. Pat. No. 5,407,413 to Kupferman (1995) discloses a integrated weight and locking system that helps lock weights together by a simple "press and turn" motion. While this system does not need a collar to secure the weights to the bar, it is a proprietary system and only works as a system; common, inexpensive barbell plates cannot be used. Standard weights plates are ubiquitous but are useless with this system. So gyms and individuals who already use standard weight plate systems couldn't use this system without a substantial investment in this new system, which would be expensive.

Another proprietary system is disclosed in U.S. Pat. No. 5,449,333 to Carter (1995). This system does away with using a collar locking device by the use of grooves in the bar itself and flexible o-rings mounted on the inside surface of the weights. The weights are locked into place by the o-ring fitting into one the grooves along the ends of the bar. Like the above disclosed device, this system only works with components designed for that system. It also suffers from the other disadvantages listed above for U.S. Pat. No. 5,407,413.

All the devices for securing weight to a weight bar heretofore known suffer from one or more of the following disadvantages:

(a) They require the user to attach a locking collar device to secure a weight to a weight bar. Then, the user must detach the device to remove the weight. This adds time and steps to changing the weight on a weight bar.

(b) The materials used in these devices are substantially hard so they offer no cushioning to the end of the weight bar. Thus, if the weight bar is dropped it can damage the floor or injure the user.

(c) They use a proprietary weight and locking system that does not accept common weight plates. Anyone who already has the common style weight would have to replace them with a proprietary system which would be expensive.

OBJECTS AND ADVANTAGES

Accordingly, several objects and advantages of the present invention are:

(a) to provide an end piece for a weight bar that accepts various weights and restrains them without the use of a collar locking device;

(b) to provide an end piece for a weight bar that cushions the end of the bar so that it cannot dent or scar delicate flooring and helps prevent injury to the user;

(c) to provide an end piece for weight bar that is inexpensive and easy to produce;

(d) to provide a end piece that can be produced in a variety of colors.

Further objects and advantages of the present invention will become apparent from the consideration of the drawings and ensuing description.

Figure 1:
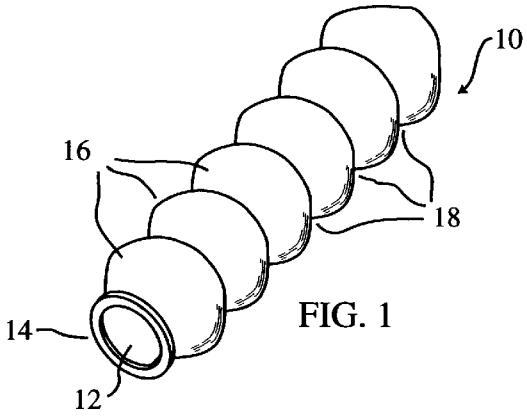
FIG. 1 is a plan view of the preferred embodiment of the present invention.

| Reference Numerals in Drawings | |
|---|---|
| 10 end cap | 12 central axial opening |
| 14 flange | 16 annular ribs |
| 18 annular grooves | 20 radially inner gripping means |
| 22 opposite end | 24 weight bar |
| 26 flexible weight | 28 weight ring |
| 30 through hole | |

DETAILED DESCRIPTION OF THE DRAWINGS

A plan view of a end cap 10 of one embodiment of the present invention is shown in FIG. 1. As shown in FIG. 1 an end cap 10 is comprised of several annular ribs 16 joined together forming annular grooves 18. At one end of end cap 10 is a central axial opening 12 that passes through the end cap 10 and terminates at the solid opposite end 22 of the end cap 10. An annular flange 14 surrounds the central axial opening 12. The material used in the construction of this invention is sufficiently pliable to offer cushioning to the end of a weight bar, without losing its ability to recover it's formed shape after being deformed by substantial outside force. As an illustrative example, the end cap 10 may be formed of a silicone. However the end cap 10 can be formed by any other materials that are flexible, but are rigid enough not to deform too easily under pressure, such as rubber, various plastics, etc.

Figure 2:
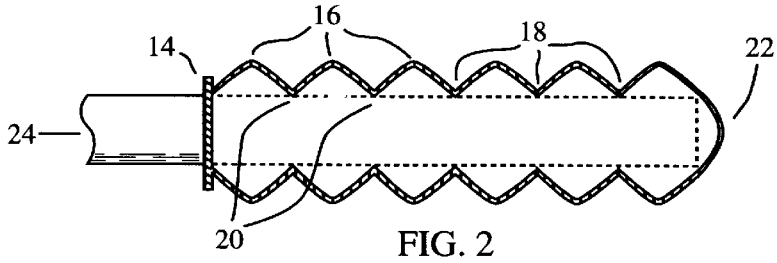
FIG. 2 is a sectional view of the device shown in FIG. 1 attached to an end of a weight bar.

FIG. 2 shows a weight bar 24 passing through the central axial opening 12 of the end cap 10. Radially inner gripping means 20 of the end cap 10 frictionally adheres to the weight bar 24 since the inside diameter of the radially inner gripping means 20 is slightly smaller than the outside diameter of the weight bar 24. If more adhesion is desired, adhesives can be applied to the weight bar 24 or the radially inner gripping means 20.

Figure 3:
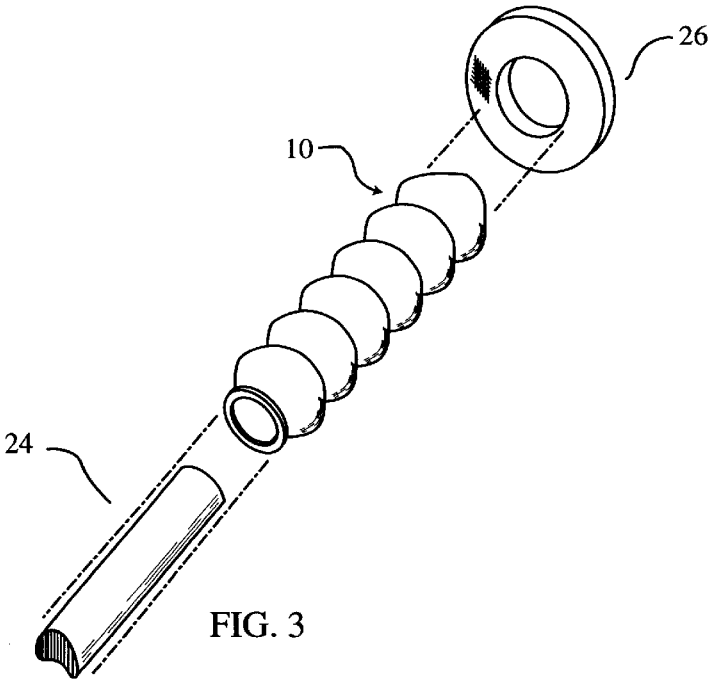
FIG. 3 is a perspective view of the device shown in FIG. 1 illustrating how it fits onto a weight bar and how a soft, flexible wrist weight fits on the device shown in FIG. 1.

FIG. 3 is an perspective view of how the end cap 10 slides over the weight bar 24. A flexible weight 26 is then attached to the end cap 10 by stretching over the end cap 10. As an example the flexible weight 24 can be a common wrist weight used by many exercisers. The wrist weight 26 is comprised of a stretchy material formed into a ring filled with lead pellets.

Figure 4:
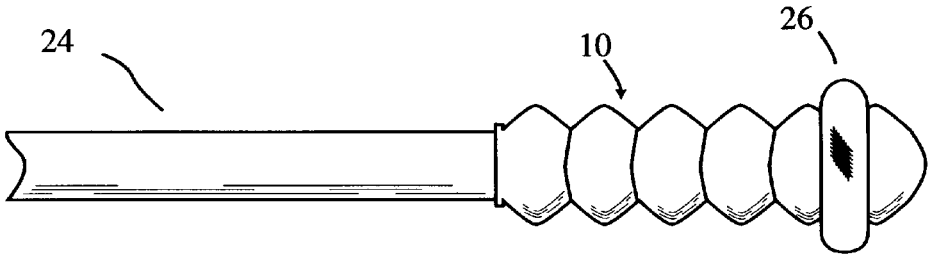
FIG. 4 is a partial side view of a weight bar with the devise in FIG. 1 attached to it and a soft, flexible wrist weight secured to the device.

FIG. 4 is a partial side view of one end of a weight bar 24 with an end cap 10 frictionally attached and a flexible weight 26 secured in an annular groove 18 between two annular ribs 16.

Figure 5:
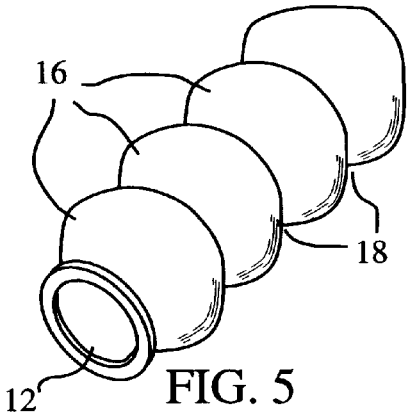
FIG. 5 is a second embodiment of the present invention.
Figure 6:
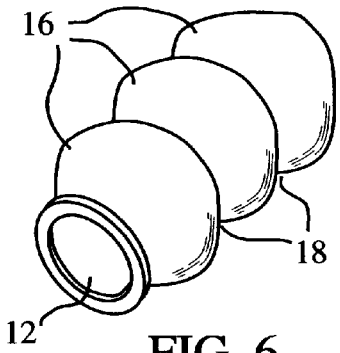
FIG. 6 is a third embodiment of the present invention.

FIGS. 5 and 6 show second and third embodiments of the present invention, in each case a plan view is provided showing that there are various possibilities with regard to the number of annular ribs 16 and annular grooves 18.

Figure 7:
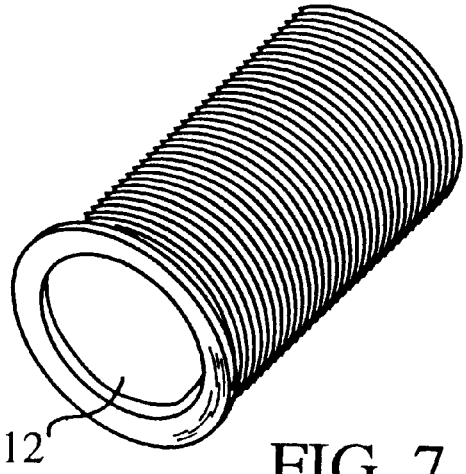
FIG. 7 is a fourth embodiment of the present invention illustrating the ribs placed closer together.
Figure 8:
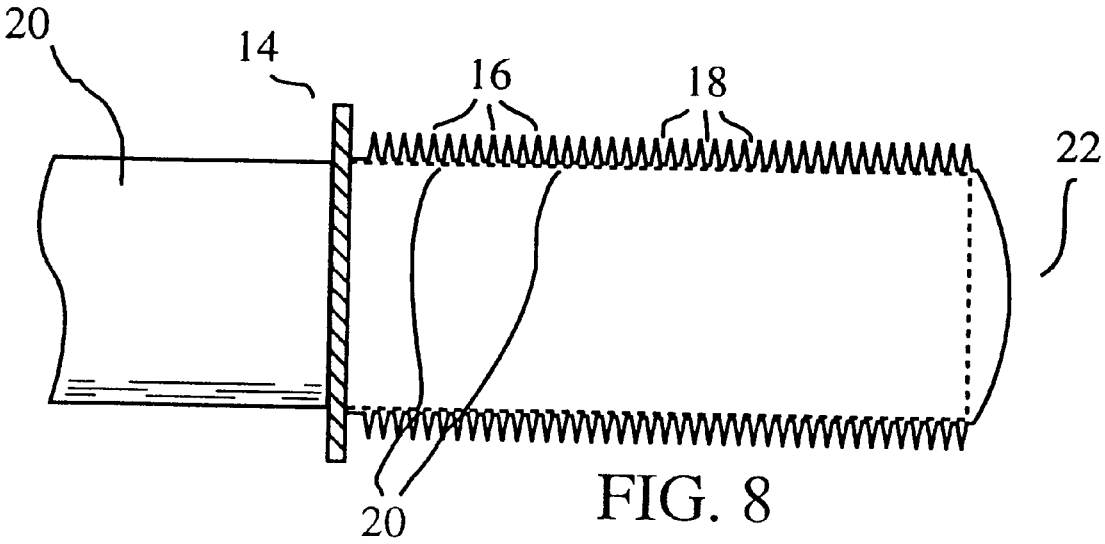
FIG. 8 is a sectional view of the device shown in FIG. 7 attached to a weight bar.

By varying the distance between the annular ribs 18 different weights can be attached to the end cap 10. In FIG. 7 a plan view of a fourth embodiment is shown. FIG. 8 shows a sectional view of the fourth embodiment of the end cap 10 frictionally attached to a weight bar 24. The distance between annular ribs 16 has been condensed and the number of annular ribs 16 has increased. The diameter of the annular ribs 16 has also been condensed.

Figure 9:
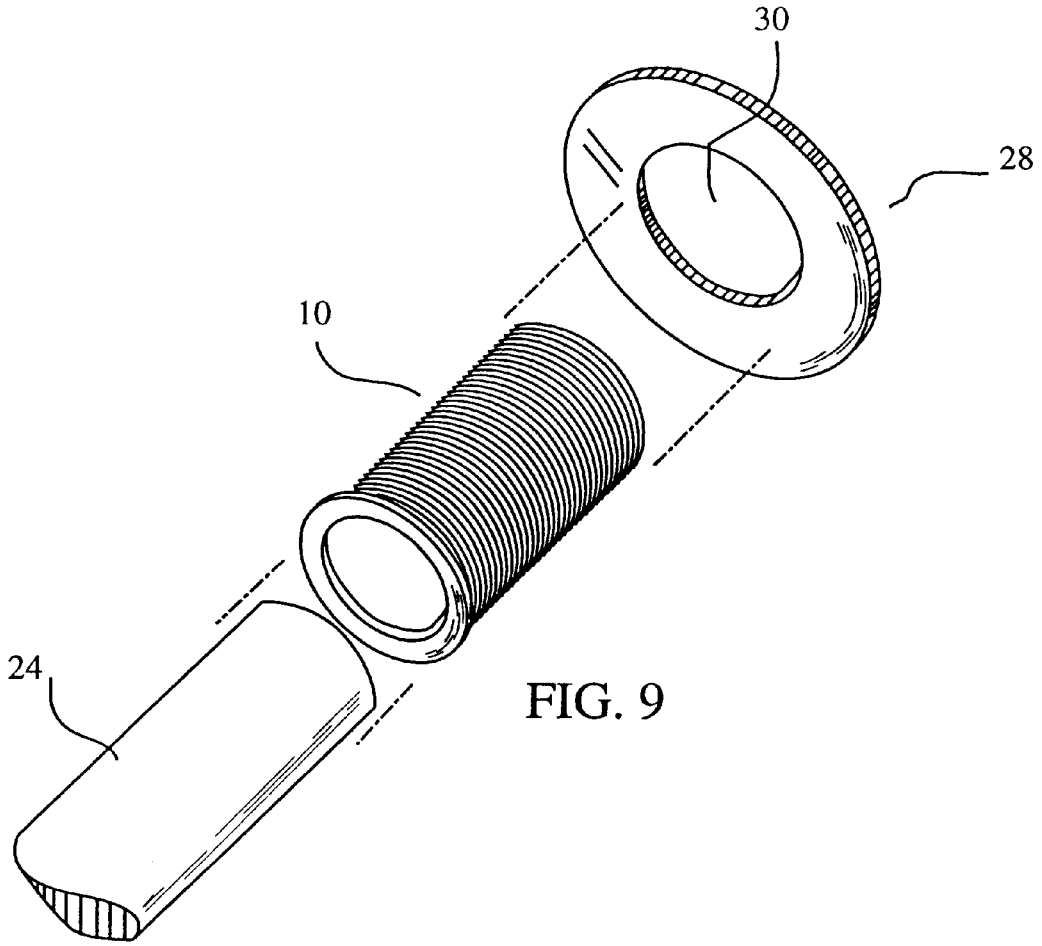
FIG. 9 is a perspective view of the device shown in FIG. 7 illustrating how it is attached to a weight bar and how a weight plate attaches onto the device shown in FIG. 7.

FIG. 9 is a perspective view of how the fourth embodiment of end cap 10 slides over the weight bar 24. A weight ring 28 is attached to the end cap 10 by sliding over the annular ribs 18 of the fourth embodiment of end cap 10.

Figure 10:
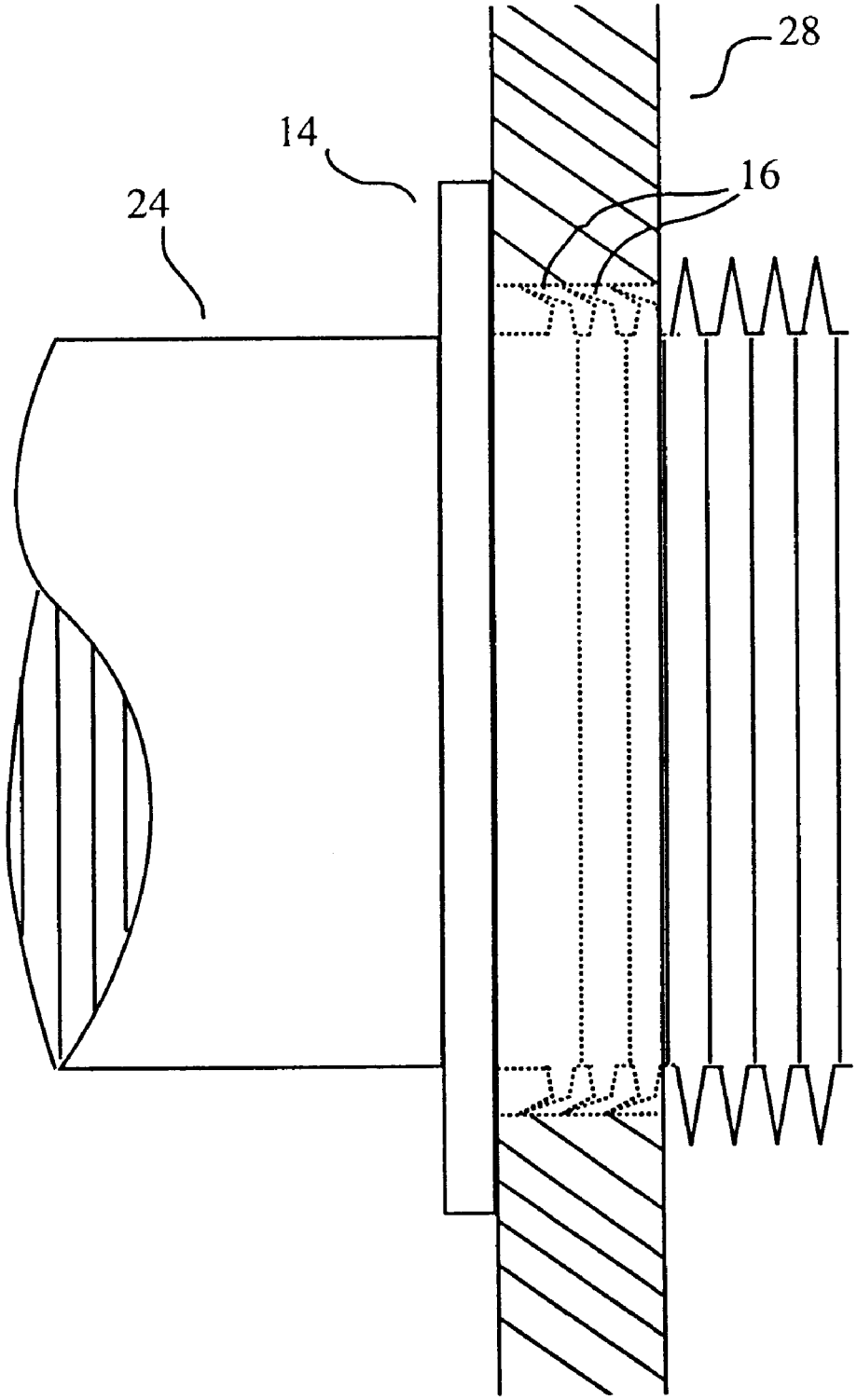
FIG. 10 is an enlarged sectional view of the device shown in FIG. 7 connected to a weight bar, receiving a weight plate.

FIG. 10 is a enlarged sectional view of the device shown in FIG. 7 connected to a weight bar 24, receiving a weight ring 28. As the user pushes the weight ring 28 onto the end cap 10, the annular ribs 16 are folded over and compressed by the inside diameter of the through hole 30 in the weight ring 26. As the weight ring 28 is pushed further down the length of the end cap 10 to the rest against the flange 14, the annular ribs 16 return to their original shape once the weight ring 28 has passed over them, thus keeping the weight ring 28 from sliding back.

Operation

An end cap 10 is attached to a weight bar 24 by inserting one end of the weight bar 24 into a central axial opening 12 located at one end of the end cap 10. The weight bar 24 passes through the end cap 10 until it reaches the opposite end 22 which is closed. Radially inner gripping means 20 frictionally retain the end cap 10 from sliding back off the weight bar 24. In the first embodiment of the present invention shown in FIGS. 1–4, a flexible weight 26, which can be a common wrist weight, is received by the end cap 10. To add more weight the user simply pushes the flexible weight 26 over the end of the end cap 10. The flexible weight stretches over the first annular rib 16 and contracts into an annular groove. The larger diameter of the annular rib 16 restrains the flexible weight 26 from sliding back off. To remove the flexible weight 26 the user merely has to pull it off. The force of the user pulling the flexible weight 26 off temporarily deforms the flexible weight 26 and allows it to slides off.

The operation of the second and third embodiments shown in FIGS. 5 and 6 is exactly the same as described above. The length of the end cap 10 can be altered to accommodate different strength levels and different bars. For instance an end cap 10 with fewer annular ribs 16 could be used on a dumbbell to accommodate it's shorter length.

In a fourth embodiment of the present invention shown in FIGS. 7–10, the annular ribs 16 are placed closer together. FIG. 8 shows a weight ring 28 and how it slides onto the end cap 10. The attachment to a weight bar 24 of the fourth embodiment of end cap 10 shown FIG. 8 is the same as with the previous embodiments. The outside diameter of the annular ribs 16 is slightly greater than the inside diameter of the through hole 30 in the weight ring 28. To temporarily secure a weight ring 28, the user pushes the weight ring over the end cap 10. As the weight ring 28 is pushed down the length of the end cap 10, the annular ribs 16 are bent over allowing the weight ring 28 to pass. The forward movement of the weight ring 28 is halted by a flange 14 at the end of the end cap 10 that has a central axial opening 12. Once the weight ring has passed over the annular ribs 16, they spring back to their original form and secure the weight ring 28 against the flange 14. To remove the weight ring 28 the user has merely to pull the weight ring 28 off of the end cap 10. The force of the user pulling on the weight ring 28 bends the annular ribs 16 in the opposite direction, allowing the weight ring 28 to be removed.

Summary, Ramifications, and Scope

Accordingly, the reader will see that the weight bar end cap of this invention can be used to receive and temporality retain differing types of weights onto the ends of weight bars without the use of a collar locking device. The weight bar end cap is able to retain a plurality of weights at one time. The present invention can be attached to most weight bars, including, but not limited to, barbells, dumbbells and curl bars. Furthermore, the weight bar end cap of the present invention has the additional advantages in that,

- it receives and retains a variety of common weights used in most health clubs and homes;
- it provides cushioning to the end of a weight bar to guard against damaging floors if dropped;
- it is easy and inexpensive to produce;
- it can be produced in a variety of colors.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

We claim:

1. An exercise weight apparatus comprising:

a weight bar;

a weight having a stretchable through hole;

an end covering secured proximate one end of the weight bar, said end covering having a plurality of annular ribs on an outer surface thereof, said annular ribs having an unstressed diameter larger than said through hole;

said through hole stretchable to be received over one said rib and retained in a groove between two said ribs.

2. An exercise weight apparatus as set forth in claim 1, wherein said weight bar is a barbell having an end covering on each end.

3. An exercise weight apparatus as set forth in claim 1, wherein said weight comprises a stretchable material formed into a ring and filled with a weight material.

4. An exercise weight apparatus as set forth in claim 3, wherein said weight material is lead pellets.

5. An exercise weight apparatus as set forth in claim 1, wherein said end covering is an end cap having a first open end received over one end of said weight bar.

6. An exercise weight apparatus as set forth in claim 5, wherein said end cap has a body of resilient material to cushion said end of the weight bar.

7. An exercise weight apparatus as set forth in claim 6, wherein said grooves, on an inner side thereof, frictionally grip the weight bar.

8. An exercise weight apparatus as set forth in claim 7, wherein said grooves, on an inner side thereof, have an unstressed diameter smaller than said weight bar.

9. An exercise weight apparatus as set forth in claim 5, wherein a flange surrounds said open end, said flange having a diameter larger than said through hole.

10. An exercise weight apparatus as set forth in claim 5, wherein said end cap is made from a material selected from the group consisting of silicone, rubber and plastic.

11. An exercise weight apparatus as set forth in claim 1, wherein said end covering is secured to said weight bar with an adhesive.

12. An exercise weight apparatus comprising:

a weight bar;

a weight having a stretchable through hole;

an end cap having a body of resilient material with an open end received over an end of said weight bar, said end cap having a plurality of annular ribs on an outer surface thereof, said annular ribs having an unstressed diameter larger than said through hole;

said through hole stretched to be received over one said rib and retained in a groove between two said ribs.

13. An exercise weight apparatus as set forth in claim 12, wherein said weight bar is a barbell having an end cap on each end.

14. An exercise weight apparatus as set forth in claim 12, wherein said weight comprises a stretchable material formed into a ring and filled with a weight material.

15. An exercise weight apparatus as set forth in claim 12, wherein said end cap has a body of resilient material to cushion said end of the weight bar.

16. An exercise weight apparatus as set forth in claim 12, wherein said end cap, on an inner side thereof, frictionally grips the weight bar.

17. An exercise weight apparatus as set forth in claim 12, wherein said grooves, on an inner side thereof, have an unstressed diameter smaller than said weight bar.

18. An exercise weight apparatus as set forth in claim 12, wherein a flange surrounds said open end, said flange having a diameter larger than said through hole.

19. An exercise weight apparatus as set forth in claim 12, wherein said end cap is secured to said weight bar with an adhesive.

20. An exercise weight apparatus comprising:

a weight bar;

a weight having a stretchable through hole;

an end cap having a body of resilient material with a first open end received over an end of said weight bar and a second closed end, said open end surrounded by a flange having a diameter larger than said through hole, said end cap having a plurality of annular ribs on an outer surface thereof and a corresponding annular grooves between two said ribs, said annular ribs having an unstressed diameter larger than said through hole, said annular grooves having, on an inner side thereof, an unstressed diameter smaller than said weight bar such that they frictionally grip said weight bar;

said through hole stretched to be received over one said rib and retained in said groove between two said ribs.

* * * * *